US010214047B1

(12) United States Patent
Haggarty

(10) Patent No.: US 10,214,047 B1
(45) Date of Patent: Feb. 26, 2019

(54) FINGER MOISTENING DEVICE

(71) Applicant: Jane C. Haggarty, Kamloops (CA)

(72) Inventor: Jane C. Haggarty, Kamloops (CA)

( * ) Notice: Subject to any disclaimer, the term of this patent is extended or adjusted under 35 U.S.C. 154(b) by 0 days.

(21) Appl. No.: 15/723,903

(22) Filed: Oct. 3, 2017

Related U.S. Application Data

(60) Provisional application No. 62/403,237, filed on Oct. 3, 2016.

(51) Int. Cl.

| | |
|---|---|
| ***B05C 21/00*** | (2006.01) |
| ***B43M 11/00*** | (2006.01) |
| ***B43M 11/04*** | (2006.01) |
| *A47K 5/00* | (2006.01) |

(52) U.S. Cl.
CPC ..... *B43M 11/00* (2013.01); *B05C 21/00* (2013.01); *B43M 11/04* (2013.01); *A47K 5/00* (2013.01)

(58) Field of Classification Search
CPC ..... B05C 1/06; B05C 21/00; B43M 11/00; B43M 11/04; A47K 5/00; A47K 2210/00; B65D 47/42; A47L 13/17; A45D 2200/1018
USPC ..... 118/264, 268; 401/183, 196, 198, 199, 401/202, 207, 131
See application file for complete search history.

(56) References Cited

U.S. PATENT DOCUMENTS

| | | | | |
|---|---|---|---|---|
| 419,419 | A | 1/1890 | Corcoran | |
| 425,834 | A * | 4/1890 | Sword | B43M 11/04 118/268 |
| 939,098 | A * | 11/1909 | Sauer et al. | B43M 11/04 118/201 |
| 1,467,040 | A * | 9/1923 | Jerabek | B43M 11/04 118/201 |
| 1,545,343 | A | 7/1925 | Mack | |
| 2,167,257 | A * | 7/1939 | Wheeler, Jr. | B43M 11/00 118/401 |
| 2,658,474 | A | 11/1953 | Kuehn et al. | |
| 2,986,307 | A * | 5/1961 | Hillebrand | A47G 33/02 118/268 |
| 3,056,999 | A | 10/1962 | Myddelton | |
| 3,357,395 | A * | 12/1967 | Lorber | B43M 11/04 118/266 |
| 4,858,555 | A | 8/1989 | Arsene et al. | |
| 2003/0202838 | A1 | 10/2003 | Sun et al. | |
| 2007/0234950 | A1 | 10/2007 | Watts | |

OTHER PUBLICATIONS

Hygienic Fingertip Moistener, Erog-Style, 1 1/2 oz. Product Listing [online]. Lee Sortkwik, 2014 [retrieved on Jul. 12, 2016]. Retrieved from the Internet:http://www.staples.com/Lee-Sortkwik-Hygienic-Fingertip-Moistener-1-1-2-oz-/product_184788.

* cited by examiner

*Primary Examiner* — Laura Edwards
(74) *Attorney, Agent, or Firm* — Cramer Patent & Design, PLLC; Aaron R. Cramer

(57) ABSTRACT

A finger moistening device has an interior, a door within a first side permitting access to the interior, a second side, a rear plate extending above the sides, a removable adhesive patch secured upon the bottom face, and a moisture retaining dabber secured upon the top face. The dabber is in environmental communication with the interior of the housing. The interior is configured to accommodate a removable cartridge comprising hand sanitizing fluid. The fluid in the cartridge is in fluid communication with the when the cartridge is secured within the housing.

20 Claims, 2 Drawing Sheets

FINGER MOISTENING DEVICE

RELATED APPLICATIONS

The present invention is a continuation of and claims the benefit of U.S. Provisional Application No. 62/403,237 filed on Oct. 3, 2016, the entire disclosures of which are incorporated herein by reference.

FIELD OF THE INVENTION

The present invention relates generally to the field of fingertip moisteners.

BACKGROUND OF THE INVENTION

Moistening devices are known that include an absorbent body of material which can be touched by the fingers to coat the fingers with moisture. In the past, various types of moisteners have been disclosed which permit wetting of fingers to facilitate handling of money or separation of sheets of paper.

During a sporting event such as football, a quarterback may lick his fingers to better grip the ball. Typically, a game environment is unsanitary and licking fingers may be considered to be unpleasant. It is also common practice among railroad employees and others in similar employment to lick their fingers while handling tickets, transfers, currency and the like. This manner of moistening the fingers is extremely objectionable for sanitary reasons.

The difficulty of opening plastic bags, particularly grocery store plastic bags for produce, has been well known. The problem is usually that the fingers are too dry to allow for sufficient friction between the fingers and the plastic bag opening. The problem has been reduced in the past by the practice of licking one's fingers to create the friction needed to open the plastic bag. This practice is far from ideal. A study by Dr. Charles P. Gerba of eighty-five (85) shopping carts found that fifty percent (50%) carried *Escherichia coli*, while seventy-two percent (72%) contained coliform bacteria and that the number of fecal bacteria found on the shopping carts was enough to cause illness if ingested. Thus, the practice of licking one's fingers is allowing the spread of germs from the fingers to the mouth. There obviously exists a need for a more sanitary method to moisten fingers.

Liquid alcohol-based hand sanitizers are well known as a preferred way to prevent the spread of bacteria and kill germs. These hand sanitizers work by destroying the outer protein layer of viruses and bacteria, effectively rendering the pathogens ineffective and when used correctly, hand sanitizers kill ninety-nice percent (99.9%) of germs within thirty seconds (30 s.) after application.

Various attempts have been made to solve problems found in fingertip moistener art. Among these are found in: U.S. Pat. and U.S. Pat. App. Pub. No. 939,098 to Potter; U.S. Pat. No. 4,858,555 to Aresene, et al.; and 2007/0234950 to Watts. These prior art references are representative of fingertip moisteners.

None of the above inventions and patents, taken either singly or in combination, is seen to describe the invention as claimed. Thus, a need exists for a reliable fingertip moistening pad for opening grocery bags or separation of currency or sheets of paper, and to avoid the above-mentioned problems.

SUMMARY OF THE INVENTION

The inventor has recognized the aforementioned, inherent problems and lack in the art and observed that there is a need for a new and improved device for a way to moisten the fingertips in order to aid in grasping of an item.

It is therefore an object of the invention to provide such a device to include a housing having a side plate, a top plate with an integral front wall, a rear plate, and a bottom plate. A door is hingedly attached to either the front wall, the rear wall, the bottom plate, or the top plate and secured to the opposing plate or wall. The door provides access to an interior. The interior includes a cartridge that can be filled with a liquid and is capable of removal from the interior. The cartridge preferably has a removable feature thereby providing access to the liquid. A dabber has a bottom end residing within the housing that extends into the cartridge and therefore is in fluid communication therewith. A dabber top end extends outside the top plate of the housing and is capable of being accessed by an individual who wants to "wet" their fingers.

In a preferred embodiment, a dabber cover is sized to completely cover the dabber top end, ostensibly for sanitation and purposes and to lessen the drying of the dabber top end. The dabber cover preferably has a tether that it is attached to. In certain embodiments, the tether is affixed within the pocket and in certain other embodiments, the tether is affixed to the rear plate.

In at least one (1) embodiment, the rear plate extends upwards past the dabber top end, the side plate, the top plate, and the door. A pocket resides on the rear surface of the rear plate and is capable of receiving and retaining the dabber cover therein.

In another embodiment, the pocket can have a semi-circular cut-out located at the upper edge, ostensibly for permitting the location of the tether end attached to the cover to travel. Other benefits of such a semi-circular cut-out is to aid in grasping of the dabber cover during removal or placement within the pocket.

In certain other embodiments, the dabber bottom end is tubular element that aids in the transfer of liquid from the cartridge into the dabber top end.

In certain other embodiments, the dabber top end is hemispherical.

In yet certain other embodiments, the housing bottom plate has an adhesive pad bonded to the outer surface to enable the housing to be adhered to a support surface.

Furthermore, the features and advantages described herein may be combined in various manners and embodiments as one skilled in the relevant art will recognize. The embodiment and examples disclosed herein can be practiced without one (1) or more of the features and advantages described in a particular embodiment or example.

Further advantages of the embodiments and examples disclosed herein will become apparent from a consideration of the drawings and ensuing description.

BRIEF DESCRIPTION OF THE DRAWINGS

The advantages and features of the embodiments and examples disclosed herein will become better understood with reference to the following more detailed description and claims taken in conjunction with the accompanying drawings, in which like elements are identified with like symbols, and in which:

DESCRIPTIVE KEY

Figure 1:
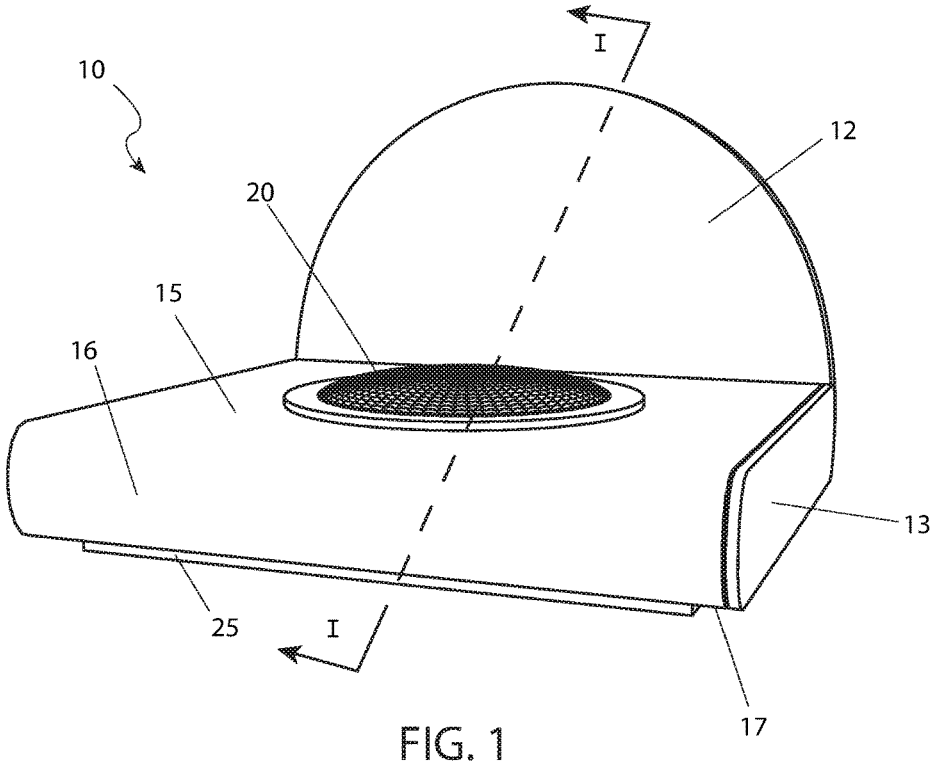
FIG. 1 is a front perspective view of an embodiment of the finger moistening device 10.

10 finger moistening device
12 rear plate
13 side door
15 top plate
16 front wall
17 bottom plate
19 side plate
20 dabber
22 dabber cover
25 adhesive
30 tether
35 pocket
40 replaceable cartridge
45 capillary tube
50 moistening liquid

DETAILED DESCRIPTION OF THE PREFERRED EMBODIMENT

The present invention is directed to a fingertip moistening device 10. In one (1) embodiment of the present invention, the device 10 is particularly suited for mounting on or near a shopping cart ostensibly for opening grocery bags.

Referring now to FIG. 1 showing a perspective view of the device 10, which preferably comprising a device body having a top plate 15, a bottom plate 17, a side plate 19, at least one (1) side door 13 providing access to an interior, a rear plate 12 extending upward from a perimeter edge of the top plate 15, and a dabber element 20 having a bottom end located within said interior and an upper end disposed as a hemispherical protrusion through the top plate 15. The top plate 15 further has a front wall 16 portion that conjoins the front edge of the top plate 12 with the front edge of the bottom plate 17. The interior is capable of acting as a retainer for a replaceable cartridge 40 (not shown in this figure) full of a moistening liquid, which the bottom of the dabber 20 can be in fluid communication therewith. The rear plate 12 creates a barrier between the dabber 20 and produce, meat, bakery items and bulk items in a grocery store, when used with a shopping cart. The device 10 may comprise a side door 13 in order to allow the removal and insertion of the replacement cartridge 40 (not shown in this figure).

In a preferred embodiment, the side door 13 is hingedly attached along a common edge to either the rear plate 12, the top plate 15, the bottom plate 17, or the front wall 16. The side door 13 located opposite the side plate 19 and has a latch at the opposing side. The side door 13 shuts firmly to provide a safe seal. The device 10 may also comprise rounded off, smooth edges so as to reduce the risk of a user being accidentally injured on sharp edges of the device 10. Double-sided adhesive 25 attached to the outside surface of the bottom plate 17 provides a means to adhere the device 10 to a surface; in particular, the surface may be the ledge of a display case in a grocery store.

The replaceable cartridge 40 may be composed of a soft recyclable material and may be air and water resistant. The replaceable cartridge 40 may comprise a seal to be removed after insertion into the device 10. The device 10 is not preferably disposable. The replacement cartridge 40 may contain the moistening liquid. The moistening liquid may be a hand sanitizing liquid so as to promote hygiene and prevent the spread of disease. The replaceable cartridge 40 is inserted into the side door 13, when opened, of the device 10 underneath the dabber 20.

The dabber 20 may have the appearance and feel of a "bingo" dabber. The dabber 20 functions as a fingertip moistening pad. The moistening liquid within the replaceable cartridge 40 (not shown in this figure) is in contact with the dabber 20 such that when the dabber 20 is pressed by a user, the moistening liquid coats the user's fingertips. Capillary action transfers the moistening liquid from the replaceable cartridge 40 (not shown in this figure) to the dabber 20. Upon the pressing of the dabber 20, a small amount of moistening liquid may be dispensed so as to give enough moisture to provide friction between the user's fingertips and the plastic bag but not enough to become slippery. Further description of the replaceable cartridge 40 (not shown in this figure) will be provided herein below.

Figure 2:
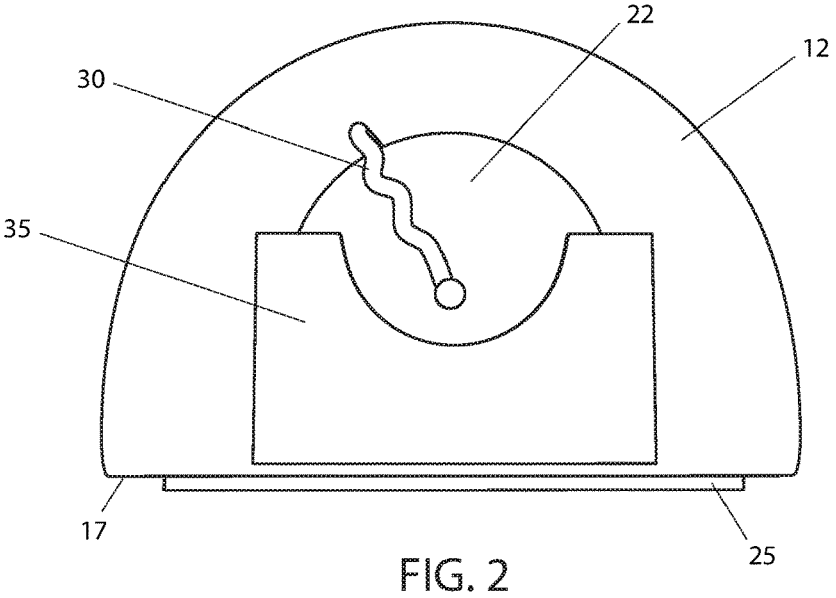
FIG. 2 is a rear elevation view of the finger moistening device 10, according to a preferred embodiment of the invention; and, FIG. 3 is a sectional view of the finger moistening device 10, as seen along a line I-I, as shown in FIG. 1, according to a preferred embodiment of the present invention.

Referring now to FIG. 2, a dabber cover 22 may be used to cover the dabber 20 in order to preserve the moisture in the dabber 20. The dabber cover 22 may be situated behind the rear plate 12 of the device 10 during store hours so that it is hidden out of sight. A pocket 35 is located on the rear of the rear plate 12, opposite the top plate 15, and preferably has a size to enable a snug fit of the dabber cover 22 therein. The pocket 35 could also have a slot to facilitate removal of the dabber cover 22. The existence of the pocket 35 is helpful during store hours so as to prevent the dabber cover 22 from moving or falling onto the ground.

A tether 30, preferably a soft plastic cord, has a first end attached to the dabber cover 22 and an opposing second end affixed to either an inner surface of the pocket 35 or the rear surface of the rear plate 12. The tether 30 may be just long enough so that the dabber cover 22 can reach and cover the dabber 20. The tether 30 prevents the dabber cover 22 from being accidentally dropped onto the floor which may cause the dabber cover 22 to become contaminated with bacteria or misplaced. Once covered, the dabber cover 22 will prevent the moistening liquid inside of the replacement cartridge 40 (not shown in this figure) and through the dabber 20 from evaporating and drying out quickly by cutting off the exposure to air.

Figure 3:
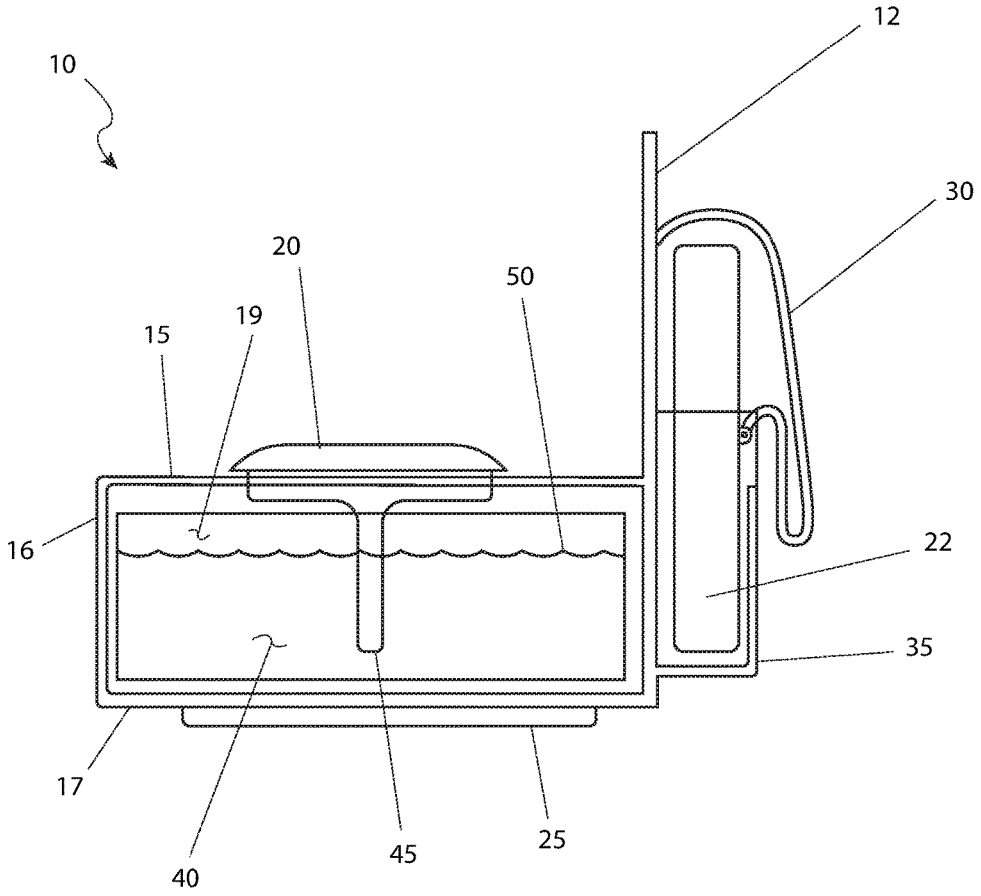

Referring now to FIG. 3, a sectional view of the finger moistening device 10, as seen along a line I-I, as shown in FIG. 1, according to a preferred embodiment of the present invention is disclosed. This figure clearly depicts the relationship between the top plate 15 and the rear plate 12. The dabber cover 22 is shown in its stowed position in the pocket 35 such as would be experienced during daily usage of the device 10. The tether 30 is of a sufficient length so as to allow placement over the dabber 20. The replaceable cartridge 40 is shown placed in the lower section of the device 10 as accessed by the side door 13 (as shown in FIG. 1). A capillary tube 45 is shown in an immersed position in the replacement cartridge 40. Capillary action draws the moistening liquid 50 inside of the replacement cartridge 40 upward and into the dabber 20 whereupon it can be accessed by the user's finger(s).

The function of the device 10 is to provide a sanitary product and to provide a means for easily opening a plastic bag in a grocery store. The device 10 may be situated close to the plastic bags in a store where the produce, meat, bakery, bulk or anywhere in the store that has bags a customer has to open on their own. A user may press their fingers into the dabber 20 to coat their fingertips in a small amount of the sanitizing liquid. The moisture on the user's fingertips then creates friction between the fingertips and the plastic bag and makes opening the plastic bag much easier.

The device 10 is useful for assisting a user with opening a plastic bag, particularly at a grocery store or any store that sells produce, meat, bakery or bulk. The device 10 aims to help any customer struggling with opening a plastic bag. The device 10 also helps the elderly, individuals with arthritis or neurological impairment, children and those who are in a hurry.

The device 10 comprises a hand sanitizing liquid. The use of the hand sanitizing liquid promotes hygiene by killing germs and preventing the spread of germs through the licking of fingers. The device 10 prevents a user from having to lick their fingers in order to obtain the moisture needed to open plastic bags. The licking of fingers for this purpose carries a huge risk of contracting diseases. The sanitizing liquid in the device 10 of the present invention kills germs and prevents the spread of disease.

The exact specifications, materials used, and method of use of the device 10 may vary upon manufacturing. The device 10 may be a unitary solid molded piece, including the top plate 15, rear plate 12, front wall 16, side plate 19, bottom plate 17, pocket 35, and side door 13.

Spatially relative terms such as "under", "below", "lower", "over", "upper", "left", "right", "front", "rear", and the like, are used for ease of description to explain the positioning of one (1) element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplate.

The invention claimed is:

1. A moistening system, comprising:
a dabber housing, comprising:
a top plate, having an integral front wall;
a bottom plate;
a side plate;
a rear plate, extending upward past a top surface of said top plate;
a door providing access to an interior; and,
a pocket located on a rear of said rear plate;
a dabber element, having a bottom end extending within said interior, and a top end extending outside and above said top plate;
a dabber cover capable of being retained within said pocket and capable of fully covering said dabber top end;
a tether, having a first end affixed to said dabber cover and a second end affixed to said rear plate; and,
a cartridge comprising a liquid;
wherein said cartridge is capable of being retained within said interior and in fluid communication with said dabber bottom end.

2. The system of claim 1, wherein said top plate, said bottom plate, said side plate, and said rear plate are a unitary construction.

3. The system of claim 1, wherein said door is hingedly attached to said bottom plate and removably secured to said top plate.

4. The system of claim 1, wherein said door is hingedly attached to said top plate and removably secured to said bottom plate.

5. The system of claim 1, wherein said door is hingedly attached to said rear plate and removably secured to said front wall.

6. The system of claim 1, wherein said door is hingedly attached to said front wall and removably secured to said rear plate.

7. The system of claim 1, wherein an upper edge of said pocket comprises a semi-circular cut-out.

8. The system of claim 1, wherein said dabber bottom end is a tubular element.

9. The system of claim 1, wherein said dabber top end is a hemisphere.

10. The system of claim 1, further comprising an adhesive pad bonded to a bottom surface of said bottom plate.

11. A moistening system, comprising:
a dabber housing, comprising:
a top plate, having an integral front wall;
a bottom plate;
a side plate;
a rear plate, extending upward past a top surface of said top plate;
a door providing access to an interior; and,
a pocket located on a rear of said rear plate;
a dabber element, having a bottom end extending within said interior, and a top end extending outside and above said top plate;
a dabber cover capable of being retained within said pocket and capable of fully covering said dabber top end;
a tether, having a first end affixed to said dabber cover and a second end affixed to said pocket; and,
a cartridge comprising a liquid;
wherein said cartridge is capable of being retained within said interior and in fluid communication with said dabber bottom end.

12. The system of claim 11, wherein said top plate, said bottom plate, said side plate, and said rear plate are a unitary construction.

13. The system of claim 11, wherein said door is hingedly attached to said bottom plate and removably secured to said top plate.

14. The system of claim 11, wherein said door is hingedly attached to said top plate and removably secured to said bottom plate.

15. The system of claim 11, wherein said door is hingedly attached to said rear plate and removably secured to said front wall.

16. The system of claim 11, wherein said door is hingedly attached to said front wall and removably secured to said rear plate.

17. The system of claim 11, wherein an upper edge of said pocket comprises a semi-circular cut-out.

18. The system of claim 11, wherein said dabber bottom end is a tubular element.

19. The system of claim 11, wherein said dabber top end is a hemisphere.

20. The system of claim 11, further comprising an adhesive pad bonded to a bottom surface of said bottom plate.

* * * * *